FIP7811 XR 4,045,085

United States Patent [19]

Garrett

[11] 4,045,085

[45] Aug. 30, 1977

[54] FRACTURING OF PILLARS FOR ENHANCING RECOVERY OF OIL FROM IN SITU OIL SHALE RETORT

[75] Inventor: Donald E. Garrett, Claremont, Calif.

[73] Assignee: Occidental Oil Shale, Inc., Grand Junction, Colo.

[21] Appl. No.: 567,509

[22] Filed: Apr. 14, 1975

[51] Int. Cl.[2] ..... E21C 41/10 E21C 43/00

[52] U.S. Cl. ..... 299/2; 299/13;

[58] Field of Search ..... 299/2, 3, 4, 13, 14; 166/259, 308, 247

[56] References Cited

U.S. PATENT DOCUMENTS

| | | | |
|---|---|---|---|
| 2,780,449 | 2/1957 | Fisher et al. | 166/259 |
| 3,004,596 | 10/1961 | Parker et al. | 166/259 |
| 3,137,347 | 6/1964 | Parker | 166/248 |
| 3,149,670 | 9/1964 | Grant | 166/259 |
| 3,409,082 | 11/1968 | Bray et al. | 166/247 |
| 3,448,801 | 6/1969 | Closman et al. | 166/247 |
| 3,578,080 | 5/1971 | Closman | 166/259 X |
| 3,586,377 | 6/1971 | Ellington | 299/4 |
| 3,593,788 | 7/1971 | Parker | 166/247 |
| 3,593,789 | 7/1971 | Prats | 166/259 |
| 3,601,193 | 8/1971 | Grady | 166/259 |
| 3,630,278 | 12/1971 | Parker | 166/259 |
| 3,659,652 | 5/1972 | Roberts | 166/308 |
| 3,661,423 | 5/1972 | Garrett | 299/4 |
| 3,674,313 | 7/1972 | Knutson | 299/13 |
| 3,677,342 | 7/1972 | Silverman | 166/308 |

*Primary Examiner*—Ernest R. Purser
*Assistant Examiner*—William F. Pate, III
*Attorney, Agent, or Firm*—Christie, Parker & Hale

[57] ABSTRACT

An underground in situ oil shale retort, having predetermined boundaries, contains a bed of fragmented oil shale particles having an appreciable void volume distributed therethrough. Air passed through this bed of fragmented oil shale supports combustion of some of the carbonaceous material in the oil shale and provides heat for retorting oil therefrom. A number of such retorts may be formed in an area and pillars are left to support the overburden. Pillars forming walls between adjacent retorts also prevent gas leakage. Oil recovery from intact oil shale pillars is enhanced by fracturing the pillars as well as fragmenting the shale in the retort. The pillars are fractured by hydraulic fracturing, electrical fracturing, liquid explosive fissuring, or the like. The fractures are propagated from access holes in the vicinity of the pillars, typically between similar holes adjacent the next retort volume when the pillars are between retorts.

26 Claims, 4 Drawing Figures

Fig. 1
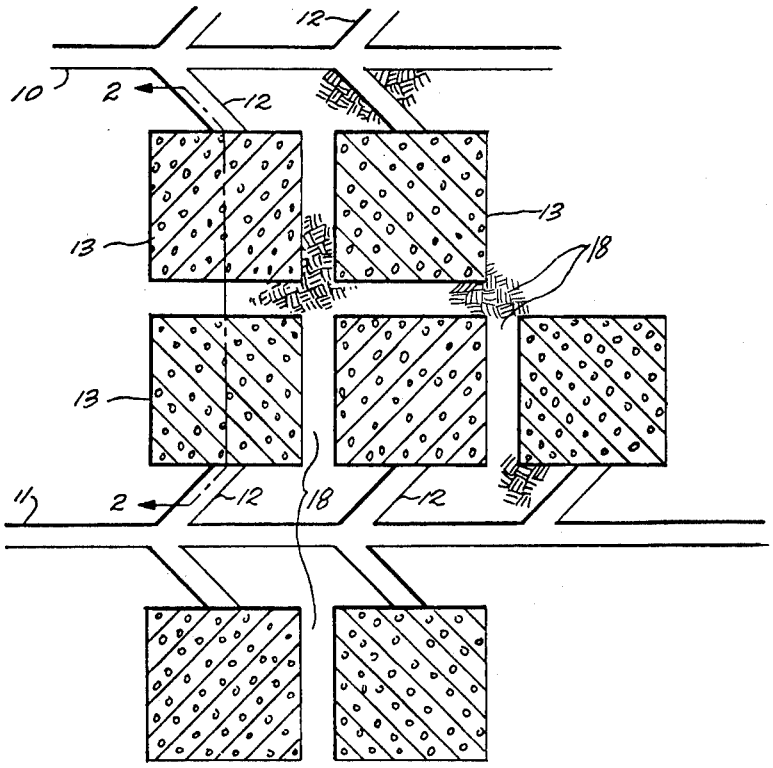
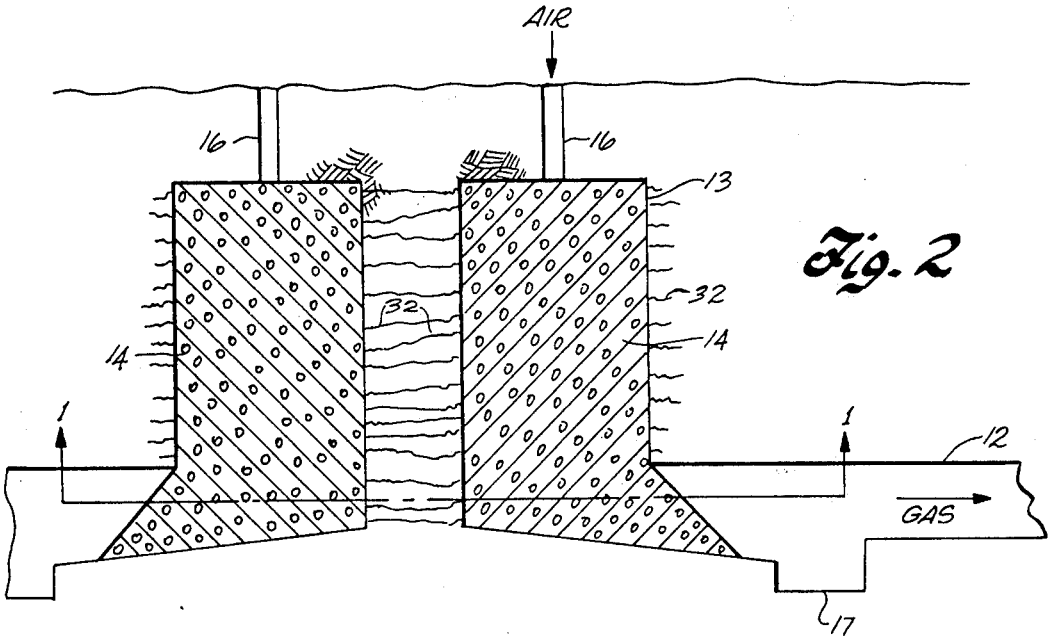
Fig. 2

FRACTURING OF PILLARS FOR ENHANCING RECOVERY OF OIL FROM IN SITU OIL SHALE RETORT

BACKGROUND OF THE INVENTION

There are vast deposits of oil shale throughout the world with some of the richest deposits being in the western United States in Colorado, Utah and Wyoming. These reserves are regarded as one of the largest untapped energy reserves available. The oil shale is in the form of solid rock with a solid carbonaceous material known as kerogen intimately distributed therethrough. The kerogen can be decomposed to a synthetic crude petroleum by subjecting it to elevated temperatures in the order of about 700° to 1500° F. This causes the kerogen to decompose to a hydrocarbon liquid, small amounts of hydrocarbon gas, and some residual carbon that remains in the spent shale. Such decomposition by heating in a retort, which can be formed underground in the oil shale deposit, is referred to as retorting.

Heat for retorting the oil shale can be obtained by burning some of the carbonaceous material in the shale with air or other oxygen supplying gas. Preferably the oil shale is retorted in situ in a bed of oil shale particles filling a cavity blasted into the oil shale deposit or formation. In such an in situ retort the rubble pile of oil shale particles is ignited at the top to form a combustion zone and air is passed downwardly through the bed to sustain the combustion zone and retort the oil shale on the advancing side of the combustion zone. Liquid oil flows to the bottom of the retort and is recovered.

As gas flows downwardly through the in situ retort three distinct but overlapping zones are created. One of these zones is the combustion zone in which much of the reaction between oxygen supplying gas and carbonaceous material in the oil shale is occurring. This zone may have appreciable thickness since the rate of combustion is to some extent controlled by the rate of diffusion of oxygen supplying gas and reaction products through solid particles of shale.

Above the combustion zone there is a zone of heated spent shale that can contain a substantial amount of unburned residual carbon. This heated shale remains at an elevated temperature long after the combustion zone has passed. Some combustion does occur in this zone of heated spent shale during retorting by reaction between oxygen and residual carbon.

Below the combustion zone in a typical retort the gas is essentially inert since the oxygen has been removed in the hot spent shale and in the combustion zone. This hot substantially oxygen free gas heats the oil shale in retorting zone, thereby decomposing the kerogen.

These zones progress downwardly through the retort at a rather slow rate of no more than a few feet per day and retorting of a large in situ retort can proceed for a substantial period of time.

To recover the maximum amount of shale oil from a given area a pattern of adjacent retorts is formed. Each of these retorts is filled with a bed of fragmented oil shale particles. Pillars of unfragmented oil shale are left in retorts and between adjacent retorts primarily to act as supports for the overburden of rock above the oil shale deposit being retorted. Typically, for example, each retort is a rectangular room filled with oil shale particles and is bounded on all sides by pillars separating it from adjacent retorts. Even with the best possible mining techniques as much as 30% to 40% of the oil shale may be left in pillars to support the overburden. In recovery schemes where the oil shale is mined and retorted at the surface all of the shale oil in the pillars is sacrificed. In underground in situ retorting some of the oil in the pillars is recovered due to heat transfer from the combustion zone and hot spent shale. This recovery of oil from the pillars is limited by diffusion rates of heat into the pillar and decomposition products out of the pillar, and appreciable amounts of oil may still be left after an area has been completely retorted.

It is therefore desirable to provide a technique for increasing the yield of oil from the pillars of oil shale adjacent in situ oil shale retorts. Such a technique should be sufficiently economical that the cost of the oil is not significantly increased. These techniques should also avoid damage to the structural integrity of the pillars so that mining hazards are not created in the retorting area and ground subsidence of the overburden is avoided. In practice of this invention this is obtained by relatively controlled fracture of essentially intact pillars with faces adjacent the fragmented shale in the in situ retort.

When nuclear devices are detonated underground to create a "chimney" containing rock fragments, there is fracturing of a portion of the rock surrounding the point of detonation of the nuclear device. Detonation pressures plastically and elastically deform surrounding rock, forming a generally spherical cavity with a lining of molten rock. After detonation, the rock above this cavity tends to collapse into the cavity, ultimately creating a vertically elongated chimney containing rock fragments. The deformed rock near this chimney that was subjected to high stresses from the nuclear detonation may contain fractures.

For example, U. S. Pat. No. 3,409,082, by B. G. Bray, et al, for a "Process for Stimulating Petroliferous Subterranean Formations with Contained Nuclear Explosions" states that the pressure waves from the explosion result in fractures in the rocks surrounding and above the detonation location. This complex fracture system results in an increase in the permeability of the matrix rock. Such fracturing is substantially uncontrolled since it is an inherent byproduct of the nuclear detonation. It is believed that most such fracturing is near the point of detonation although minor fractures may extend for a large distance towards the ground surface, as indicated in FIG. 1 of that patent.

Other patents, such as, for example, U.S. Pat. No. 3,698,478 by Harry W. Parker, entitled "Retorting of Nuclear Chimneys", suggest by the drawings that fracturing of the rock around a nuclear chimney is uniform throughout the height. It is believed that this is only a semi-schematic representation and not indicative of an observed effect.

BRIEF SUMMARY OF THE INVENTION

There is, therefore, provided in practice of this invention according to a presently preferred embodiment a method for enhancing the ease of flow of shale oil during retorting from oil shale pillars having faces adjacent the fragmented or rubblized oil shale in an in situ retort by fracturing or fissuring the pillar of oil shale adjacent the boundaries of the retort. Thereafter explosives are detonated within the boundaries of the in situ retort to fragment the oil shale therein and provide substantial gas permeability in the fragmented oil shale. The pillars are fractured prior to retorting, by electro-linking, hydraulic fracturing, explosive liquid fracturing or combinations of these techniques. The fractures are propagated into the pillar from an access hole in the vicinity of the pillar.

DRAWINGS

These and other features and advantages of the present invention will be appreciated as the same becomes better understood by reference to the following detailed description of a presently preferred embodiment when considered in connection with the accompanying drawings wherein:

FIG. 1 is a semi-schematic horizontal cross section illustrating a number of in situ oil shale retorts;

FIG. 2 is a semi-schematic vertical cross section illustrating a pair of in situ oil shale retorts;

Description

Figure 3:
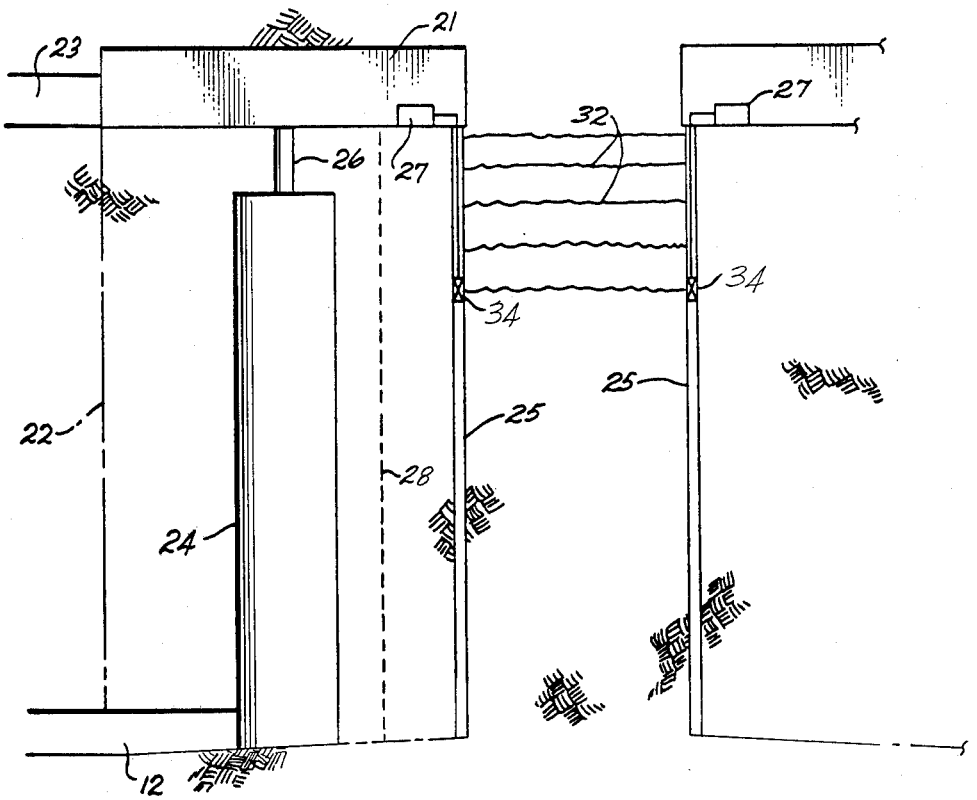
FIG. 3 is a semi-schematic vertical cross section illustrating a preliminary step in forming an in situ retort.

FIGS. 1 and 2 are horizontal and vertical semi-schematic cross sections of a number of underground or in situ oil shale retorts prepared in accordance with principles of this invention. As illustrated in this presently preferred embodiment, a pair of parallel access tunnels 10 and 11 are formed in the undisturbed oil shale deposit or formation. A number of lateral drifts 12 are provided from each of the access tunnels. Each drift leads to an individual in situ oil shale retort 13. The illustrated retorts are square or nearly square in horizontal cross section and have a pair of sides substantially parallel to the access of tunnels 10 and 11. The lateral drifts 12 are conveniently arranged at about 45° from the access tunnels to facilitate the movement of mining equipment.

Each in situ retort is a cavity substantially filled with a bed or fragmented oil shale particles 14. The bed of rubble pile of oil shale particles is created explosively as described in greater detail hereinafter. A conduit 16 communicates with the interior of each retort 13 at the top and during retorting operations air or other retorting gas is introduced through the conduit for retorting the oil shale in the respective retort. Flue gas or off gas from the bottom of each retort is recovered through the respective drift 12. Gas tight bulkheads (not shown) are typically mounted in the drifts during retorting operations to control gas in the access tunnels. A sump 17 is provided in each drift for recovering oil from the adjacent retort.

The adjacent in situ retorts 13 are spaced apart by "pillars" 18 of unfragmented oil shale. Pillars are commonly left in underground mining operations so that the compressive strength of the remaining rock supports the overburden above the pillars and above mined out areas. In a retort of large cross-sectional dimensions, one or more pillars (not shown) of square, circular or other cross section can be located within the gas retaining walls of the retort.

In the case of in situ oil shale retorting the retort volume is not completely mined out, but the blasting pattern creates the boundaries defining the retort and simultaneously fills it with a rubble pile of fragmented oil shale. Thus, after blasting, the retort volume filled with fragmented oil shale may still have substantial capability for supporting overburden. Since the fragmented shale in the in situ retort can still support at least part of the overburden and also provide lateral support for the pillars, the pillars can be made narrower than in a mine where the fragmented shale is removed for retorting above ground. It will be noted from FIG. 1 that the illustrated pillars form the boundaries of the retorts and separate them from each other. Thus they also serve as barriers to inhibit the flow of gas between adjacent retorts.

Undisturbed oil shale has little natural porosity and flow of gas or oil through the shale is quite slow. Heat transferred from the fragmented oil shale in a retort into the pillars decomposes the kerogen therein and the resultant gas and oil must diffuse through a portion of the pillar into the fragmented oil shale in the retort in order to be recovered. It might be noted that retorting and decomposing kerogen increases the permeability of the shale. Diffusion of the decomposition products through spent shale is, therefore, more rapid than through unretorted shale. For this reason, oil and gas generated in the pillars diffuse, albeit slowly, primarily towards the heated retort rather than more deeply into the pillar. It is desirable to enhance the diffusion of oil and gas from the pillars to speed up recovery, increase yield and further to minimize the exposure of oil to higher temperatures which can cause cracking of the hydrocarbons.

Figure 4:
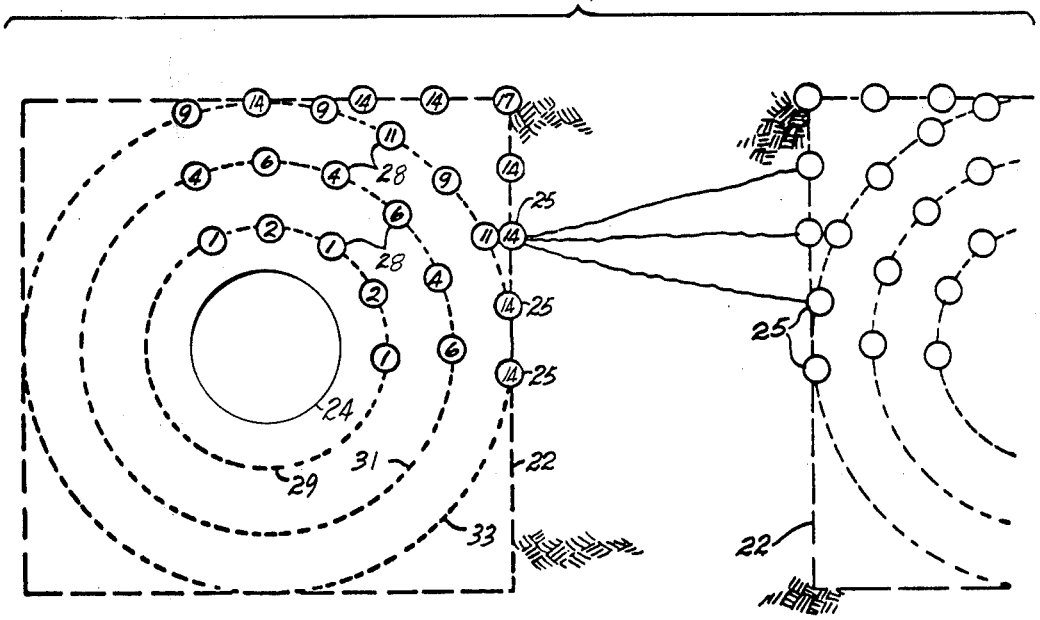
FIG. 4 is a semi-schematic horizontal cross section further illustrating preliminary steps in forming an in situ retort.

FIGS. 3 and 4 illustrate semi-schematically in vertical and horizontal cross sections, respectively, the arrangement in a retort volume preceding the blasting that fragments the oil shale and creates the retort. Additional details of the mode of forming a retort are set forth in U.S. patent application Ser. No. 505,457, filed Sept. 12, 1974, now abandoned entitled "Method of Fragmenting Ore For In Situ Recovery of Constituents" by Gordon French and assigned to Occidental Petroleum Corporation, assignee of this application. As illustrated by this embodiment, a room 21 is mined out by conventional mining techniques at the top portion of the volume to become the oil shale retort. In the illustrated embodiment the room 21 is at the top of the ultimate retort volume. Other arrangements with the room at the bottom or in an intermediate portion of the retort are also suitable. Support pillars of oil shale may be left within the room to protect mining operations.

The transverse dimensions of this room 21 are approximately the same as the horizontal cross section of the retort to be formed. The predetermined boundaries of the shale to be fragmented and of the retort to be formed are indicated by the dashed lines 22. When a pillar is located within the outer boundaries of an in situ retort, there will also be boundaries between the face or faces of such pillar and the adjacent fragmented oil shale in the retort. The room 21 may be slightly larger than the final retort cross section to permit access of drilling equipment near the walls. Access to the room 21 is through a lateral tunnel 23. The height of the room is only sufficient to accommodate the drilling equipment needed for preparing blast holes.

A center cylindrical raise 24 is mined out below the room 21 by conventional raise forming techniques. Thus, for example, in the illustrated arrangement, access to the bottom portion of the volume that is ultimately to become the in situ oil shale retort is obtained through the lateral tunnel 12 through which oil and gas are subsequently recovered. A vertical hole is drilled between the room 21 at the top and the access tunnel at the bottom. This hole may be reamed to a larger diameter and blasted out to form the center raise 24. Rubble formed as the raise is blasted can be removed through the lower tunnel 12. Ordinarily when this is done only the smaller reamed hole 26 extends to the top room 21 so that the hazard of equipment falling into the large raise is avoided.

Typically the volume of the raise 24 is in the order of about 10 to 25% of the total volume of the retort to be formed. When the oil shale in the retort is fragmented by blasting, the void volume of the raise 24 and room 21 becomes distributed between the oil shale fragments. Thus, for example if the total volume of the raise and room is about 20% of the ultimate retort volume, the rubblized bed of fragmented oil shale will have an average void volume of about 20% distributed therein. The blasting causes the oil shale fragments to be displaced and the shale "bulks up" to completely fill the retort volume.

Before blasting the volume of oil shale to form the proposed retort, and often before forming the center raise 24, a row of holes 25 is drilled in a band between the volume of oil shale to become the fragmented oil shale in the in situ retort and the oil shale to be left unfragmented as a supporting pillar. In this embodiment the drill holes are along the boundary 22 defining the retort volume and in some cases can subsequently be used as blasting holes when the oil shale within the retort volume is fragmented. The pillar between a pair of adjacent retorts is fractured from this band of drilled holes, usually in cooperation with a similar band of holes along a side of the adjacent retort volume. Although it is convenient to have the holes on the boundary because of possible multiple usage, they can be anywhere in the vicinity of the boundary, either within the proposed retort volume or in the pillar.

As illustrated in FIG. 3 pillar fracturing devices 34 are lowere down one or more of the drilled holes 25. A power source 27 is connected to the fracturing device. Fracturing of the pillars preferably occurs at a series of positions along the length of the drilled holes and may proceed from the bottom up or from the top down. The fractures 32 that form in the pillars tend to follow planes of weakness such as cleavage planes, joints or slip planes; however, the fractures may lie in substantially any orientation. Generally in oil shale the fractures follow planes of weaknesses and extend in substantially horizontal and vertical planes in the pillars.

One technique for fracturing the oil shale involves what is known in the art as electro-linking. According to this technique electrodes are placed in a pair of drilled holes and a sufficient current passed therebetween for fracturing the oil shale between the holes. Thus, in the illustrative embodiment the fracturing devices 34 are suitable electrodes and the power source 27 is an electrical power supply for providing the required currents and voltages. The voltage and power consumption for successful electro-linking depends on the initial impedance of the oil shale between the selected pair of drilled holes. This depends on the grade of shale and the distance between the holes, and may also be affected by pre-existing fractures or other local artifacts.

Generally speaking, a substantial voltage, often amounting to several thousand volts, is applied between the electrodes 26 in a pair of bore holes. Initially a rather small current, for example, a few amperes, may flow but gradually, or in some case suddenly, the impedance of the oil shale decreases so that there is increased current flow, sometimes as much as 100 amperes or more. The decreased impedance indicates that fractures have been formed. The heating due to current flow may retort some of the oil shale, thereby increasing porosity along the current path even if extensive fissures are not opened. If the current flow is maintained for a sufficient time some carbonization of the oil shale along the current flow path may occur. Power supplies capable of delivering 500 kva are desirable. Voltages may be as much as 100 volts per foot between electrodes initially and decrease as heating occurs.

Additional details of techniques for electrical fracturing of oil shale are described by M. N. Melton and T. S. Cross in a paper entitled "Fracturing Oil Shale with Electricity", *Quarterly of the Colorado School of Mines,* (July 1967), pages 45 to 61. Other descriptions are given by G. G. Campbell, W. G. Scott and J. S. Miller, in "Evaluation of Oil Shale Fracturing Tests near Rock Springs, Wyoming", *Report of Investigations 7397, U. S. Department of the Interior, Bureau of Mines.*

Another technique for fracturing the pillars which may be used by itself or after initial electro-linking is hydraulic fracturing similar to that used in oil wells, for example. When this technique is employed the fracturing devices 34 are conventional straddle packers positioned in the hole and the power source 27 may be a high pressure hydraulic pump. A straddle packer is an inflatable device used in oil wells for sealing the drill hole at a pair of spaced apart points. This provides a means for isolating a section of the drill hole for application of hydraulic pressure. The hydraulic pressure may be applied from a single drill hole or through several drill holes at the same time.

In effect, the hydraulic pressure in the oil shale formation adjacent the drill hole is sufficient to overcome forces within the formation and to fracture the formation. As a general rule it is considered that a hydraulic pressure of about 0.9 to 1.2 psig per foot of overburden thickness is required to fracture a formation. The required pressure depends on the strength of the oil shale and the overburden depth. Typically the hydraulic fracturing pressure for oil shale deposits may be 500 to 2500 psig or higher.

Water is typically used as the hydraulic fracturing medium and substantial volumes of water may penetrate the oil shale formation during hydraulic fracturing. The hydraulic fracturing may also include sand or other hard material as a fracture propping agent in the same manner used in oil well fracturing. According to this technique relatively coarse sand is mixed with gelled water. This mixture is used as the hydraulic fracturing medium so that both sand and water are pumped into the formation. The sand in the fractures helps keep the fractures propped open after hydraulic pressure is released. The coarse sand in the resulting fissures gives the formation appreciable permeability. Metal or even combustible propping agents are available and can be used in the oil shale fracturing. In some cases pneumatic instead of hydraulic fracturing can be used. If an explosive gas mixture is used, it can be ignited after forcing into the formation to temporarily increase pressure.

When hydraulic fracturing is used alone the fracture pattern follows natural planes of weakness of the oil shale. To some extent the pattern of fracturing can be controlled by initiating fractures by electro-linking. In such an embodiment the formation is first fractured by electro-linking and the fractures are enlarged by hydraulic pressure. Hydraulic fracturing is commonly used in oil field operations and its application to oil shale is described in the above-mentioned report by Campbell, et al.

Fractures in the pillars also can be created or enhanced by explosive fracturing either alone or following hydraulic fracturing. According to this technique it is not essential that a fracturing device 34 be placed in the drill holes, but this is still preferred. Preferably the fracturing device comprises a straddle packer or the like, which assures that the explosives are isolated in a preselected portion of the drill hole. A liquid explosive such as desensitized nitroglycerine is placed in the drill hole and forced into natural or artificially created fissures in the formation by pneumatic or hydraulic pressure. Depending on the extent of fractures and safety considerations, quantities of nitroglycerine of 100 to 300 quarts per hole may be used, or larger amounts in some cases. A detonator is then placed in the drill hole and detonated by a surface power source to set off the liquid explosive charge in the oil shale.

When the liquid explosive is detonated a large volume of hot gas is generated in the oil shale, and this may enlarge the width and area of existing fractures and induce additional fractures. Since the liquid explosive is forced into the oil shale formation fracturing is much more effective for a given quantity of explosives than if the detonation were confined to the drilled hole itself.

Techniques for fracturing by use of liquid explosives are described by J. L. Eakin and J. F. Miller in a paper entitled "Explosives Research to Improve Flow Through Low Permeability Rock" in the *Journal of Petroleum Technology,* (November, 1967), pages 1431 to 1436. Additional examples in oil shale are described in the above-mentioned paper by Campbell, et al.

It will be recognized that fracturing by the above-mentioned techniques will not necessarily be confined solely to the oil shale to remain as pillars. Some fracturing may extend into the oil shale to be fragmented when the retort is explosively formed. This is particularly true in hydraulic and liquid explosive fracturing where control of directionality may be difficult and rarely practiced. No harm is done by fractures extending into the volume of oil shale to become the in situ retort and such fracturing may be beneficial in some circumstances since it can enhance fragmenting. Fracturing of the oil shale in a volume to become an in situ retort before fragmenting thereof is described in copending patent application Ser. No. 447,240 now abandoned by Richard D. Ridley, entitled "Process for Preconditioning Oil Shale Seams Preliminary to Expansion of the Seam and In Situ Retorting" and assigned to the same assignee as this application.

In one embodiment of this invention the pillars between adjacent oil shale retorts are initially fractured by the above-described electrical technique. Thereafter the fractures so formed are enlarged by hydraulic fracturing with or without sand propping. Finally liquid explosives are forced into the fissures and detonated for additional fracturing. Thereafter, explosives are detonated in the retort volume to fragment the oil shale therein. Such pillar fracturing induces appreciable permeability in the pillars so that oil retorted from shale therein can travel to the retort with greater ease. The permeability of the pillar is still quite low by comparison with the permeability of the fragmented oil shale in the retort and minimal gas leakage through the pillar bounding the retort volume is encountered.

The pillrs are thus formed of essentially intact oil shale even though it has a pattern of fractures. Fracturing of the pillars in this manner reduces their tensile and shear strength but does not significantly affect their compressive strength. The ability of the pillars to support overburden is, therefore, not significantly impaired. Such a technique would be generally unsuitable for room and pillar mining where the oil shale is removed for above ground retorting since the side walls of the pillars would not be supported. In an in situ oil shale retort, on the other hand, the rubble pile of fragmented oil shale in the retort volume provides lateral support for the adjacent pillars and prevents collapse of the pillars, even though their permeability has been increased by fracturing.

After the pillars have been fractured by any or all of the above-mentioned techniques, the retort volume is prepared for fragmenting. Blasting holes are drilled in the volume to become the in situ retort and loaded with explosives for fragmenting the shale therein. In some cases the blasting holes may be prepared prior to or during fracturing of the pillars, however, if explosive fracturing is employed it is preferred to form the blasting holes subsequent to the explosive fracturing is employed it is preferred to form the blasting holes subsequent to the explosive fracturing of the pillars. The holes 25 used for pillar fracturing may also be used as blasting holes in some embodiments. Explosive fracturing of the oil shale in the pillars may require that the drilled holes be cleaned or reamed before loading with explosives for fragmenting the shale in the retort volume. Alternatively new blasting holes may be drilled for the fragmenting operation.

For fragmenting the shale in the retort volume, a number of blast holes 28 within the retort volume are drilled from the room 21 parallel to the raise 24. As seen in the horizontal cross section of FIG. 4 a number of these holes are drilled in a ring 29 concentric with the raise (only one such blast hole is indicated in FIG. 3). Another ring of holes 31 is provided around this inner ring and a third outer ring 33 is provided around this one. Additional rings of blast holes may be provided but it is preferred to keep the number as small as feasible because of timing difficulties that are encountered as larger numbers of rings are employed. Additional blast holes 25 are drilled along the boundaries 22 of the retort volume. These blast holes are typically in the range of from about 3 to 6 inches in diameter and extend the full vertical height of the retort to be formed.

The blast holes are loaded with conventional mining explosives such as dynamite, explosive slurries, or a mixture of ammonium nitrate and fuel oil (ANFO). Electrical detonators are provided in each blast hole for initiating the mining explosion.

Preferably conventional time delay detonators are used so that the charge in the blasting holes is detonated in the following sequence of steps:

a. ring 29;
b. ring 31;
c. ring 33;
d. border 22 with the exception of the corner holes; and
e. the corner holes of border 22.

Thus, the shale adjacent the raise 24 is explosively expanded into the raise and to some extent into room 21 in concentric rings moving outwardly from the raise. Blasting in concentric rings with time delay therebetween is used so that each ring is blasting to a "free face" or an interface between rock and void volume. This is of importance since appreciable fragmenting of shale by conventional explosives is obtained only when the explosive force can interact with a free face. A series of rings of explosives are needed because of limitations of the volume of shale between the free face and blasting hole that can be moved by the quantity of explosives a hole of given diameter can accommodate.

Thus, the time delay between each of the above steps is sufficiently large, e.g. 100 to 150 milliseconds to permit the layer of shale between each ring to completely break away from the remaining shale surrounding it, thereby creating a new free face, prior to detonation of the next ring of blasting holes. This assures that the shale fragments, rather than simply fracturing as it does when the pillars are fractured explosively. On the other hand the time delay between each of the above steps is preferably small enough that the layers of shale do not fall appreciably before the blasting sequence is completed. This assures a desired horizontal uniformity of the permeability of the fragmented shale in the retort.

Within each ring of blast holes there is a small delay, e.g. from 25 to 100 milliseconds between detonation of alternate holes to cause the shale to break up vertically in the vicinity of the holes to provide better fragmentation. The detonators for the blasting holes are provided with conventional delay fuses that are triggered simultaneously. The numbers of these delay fuses are indicated in FIG. 4 inside the respective blasting holes. (These holes are drawn larger than actual scale to accommodate the numbes and fewer holes than present in a full scale retort are shown in the drawing.) As measured from the instant of triggering the fuses the following correspondence between fuse numbers and time delays exists:

| Fuse Number | Time Delay |
|---|---|
| 1 | 25 milliseconds |
| 2 | 50 |
| 4 | 100 |
| 6 | 150 |
| 9 | 250 |
| 11 | 350 |
| 14 | 500 |
| 17 | 800 |
| 19 | 900 |
| 20 | 1000 |

"Fragmenting" and "fracturing" should be distinguished. When the oil shale is fragmented it is broken into individual pieces and moved an appreciable distance from its original location. Many of the pieces also change orientation somewhat or are displaced relative to adjacent pieces so that the particles occupy considerably more volume than the unfragmented rock due to the volume of the void spaces between particles. When oil shale is fractured small fissures are produced and there may be some displacement of the pieces of oil shale to accommodate the relatively small void volume in these fissures. The particles change orientation only slightly, if at all, so that the fissures have relatively small void volume.

The fracturing in the pillars provides regions of enhanced permeability through which oil and gas produced from the kerogen can diffuse with greater ease than through completely undisturbed shale. The absence if appreciable fragmenting in the pillars that remain in place leaves their compressive strength essentially intact so that there is continued support of the overburden. Since the rubble pile of fragmented shale in the retort remains in place there is no safety hazard introduced by the fracturing of the support pillars.

In an exemplary embodiment an in situ retort about 120 feet square and over 300 feet tall is formed in an oil shale formation. Drill holes are made in the formation with pairs of holes spanning a region to become a pillar adjacent a retort. An electric current is passed between the drill holes at a series of elevations to establish a number of weakened and somewhat porous fractures. Such electro-linking is repeated between a series of drill holes until a desired pattern of fractures is generated. Packers are positioned in one or more drill holes and water with a sand propping agent is forced into fissures by hydraulic pressure. Often this enlargement of the fractures follows the paths of electro-linking, and sometimes it follows natural slip planes, joints or other natural planes of weakness. If desired, explosive fracturing can also be used to further enlarge the fractures.

After prefracturing, the above described mining operations are conducted and the oil shale in the retort volume fragmented by blasting to a raise. A variety of other fragmentation techniques may also be used to form the in situ retort, as, for example, described in copending application Ser. No. 505,457 entitled "Method of Fragmenting Ore For In Situ Recovery of Constituents" by Gordon B. French and assigned to the same assignee at this invention.

The top of the rubble pile of oil shale particles in the retort is ignited by any of a variety of techniques, many of which are conventional, or by one of the methods described in copending applications Ser. No. 492,593 now U.S. Pat. No. 3,952,801, entitled "Method for Igniting Oil Shale Retort", and Ser. No. 492,600, now U.S. Pat. No. 3,990,835 entitled "Burner for Igniting Oil Shale Retort", both filed on July 16, 1974, by Robert S. Burton, III and assigned to the same assignee as the present invention. Oxygen supplying gas which is generally air diluted somewhat with inert or reducing gas (such as retort off gas) is forced into the top of the retort and flue gas or off gas is withdrawn from the bottom. This downward flow of gas generates heat of combustion as the oxygen supplying gas reacts with carbonaceous material in the oil shale in a combustion zone. This heat is carried down by flowing gas and heats oil shale in a retorting zone below the combustion zone. Kerogen is decomposed in the retorting zone to yield shale oil which percolates to the bottom of the retort for recovery and gases which mix with gas from the combustion zone and are withdrawn from the bottom of the retort as retort off gas.

Heat from the combustion zone and from a zone of heated spent shale trailing the combustion zone diffuses into the pillars of fractured but otherwise intact oil shale. Kerogen in the pillars decomposes and the resulting oil and gas gradually reach the fractures and flow into the retort volume for recovery with products from the retorting zone.

If desired, the fragmented oil shale in the retort can be heated and retorted by other retorting gas, such as, for example, hot oxygen free gas. Similarly, although described with respect to a vertical in situ retort, principles of this invention are useful in other orientations of retort. For example, the principal length of the retort may be tilted to accommodate the dip of an oil shale deposit.

Although limited embodiments of techniques for fracturing oil shale in pillars adjacent a retort boundary have been described and illustrated herein many modifications and variations will be apparent to one skilled in the art. Thus, for example, the holes for fracturing the pillars may be angled into the pillars rather than being exactly parallel to the retort boundary. The holes for fracturing can be in the pillars rather than along their boundary with the retort volume. Since the access drill holes for fracturing the pillars may be in the pillars, in the volume to become the retort or at the boundary therebetween, they are stated herein to be "in the vicinity" of the pillars to include all three possibilities or combinations thereof. Such holes are conveniently drilled from the room used in forming the retort, but they can also be drilled from the ground surface or from access tunnels near or above the retorts. Other fracturing techniques used in oil well technology may be used in addition to those specifically described above.

Another arrangement for forming voids and fragmenting oil shale in an in situ oil shale retort is described in copending U.S. patent application Ser. No. 597,481, now U.S. Pat. No. 4,025,115 entitled "Method of Enhancing Recovery of Oil from Pillars Adjacent In Situ Oil Shale Retort", which is being filed concurrently herewith and assigned to the same assignee as this application. The disclosure of that application is hereby incorporated by reference. That application describes fracturing pillars having faces adjacent an in situ oil shale retort by a different technique. Many other modifications and variations will be apparent to one skilled in the art and it is therefore to be understood that within the scope of the appended claims the invention may be practiced otherwise than as specifically described.

What is claimed is:

1. A method for recovery of shale oil from a fragmented permeable mass of particles in an in situ oil shale retort in a subterranean formation containing oil shale and from fractured unfragmented formation containing oil shale adjacent the fragmented permeable mass, said retort having pillars of a first portion of unfragmented formation defining boundaries for the fragmented permeable mass of particles, said fragmented permeable mass being obtained by fragmenting part of a second portion of the formation within such boundaries, comprising the steps of:

fracturing unfragmented formation containing oil shale in the first portion and adjacent the second portion;

excavating a part of the second portion of the formation to form at least one void and leaving a remaining unfragmented part of said second portion extending away from such an excavated void, the excavated void volume being in the range of from about 10 to 25 percent of the volume of the fragmented permeable mass being formed;

explosively expanding said remaining part of said second portion toward such an excavated void for forming the fragmented permeable mass of particles; and retorting the fragmented permeable mass of particles containing oil shale and fractured formation containing oil shale adjacent to the fragmented permeable mass for recovering carbonaceous products including shale oil therefrom.

2. A method as defined in claim 1 wherein the fracturing step comprises:

forming a hole in unfragmented formation containing oil shale in the vicinity of such a boundary;

forming another hole in said first portion of unfragmented formation containing oil shale, such hole being spaced apart from the first hole; and passing a sufficient electric curent between electrodes placed in the two holes for fracturing at least a portion of the unfragmented formation containing oil shale therebetween in said first portion.

3. A method as defined in claim 2 wherein the fracturing step further comprises:

applying a sufficient hydraulic pressure to the unfragmented formation containing oil shale along a portion of the length of at least one of the holes for fracturing at least a portion of the unfragmented formation containing oil shale adjacent that portion of the hole.

4. A method as defined in claim 3 wherein the fracturing step further comprises:

placing liquid explosive in a portion of the length of at least one of the holes adjacent the unfragmented formation containing oil shale and having fractures extending away from such hole;

introducing the liquid explosive into at least a portion of such fractures; and detonating the liquid explosive.

5. A method as defined in claim 2 wherein the fracturing step further comprises:

placing liquid explosive in a portion of the length of at least one of the holes adjacent the unfragmented formation containing oil shale and having fractures extending away from such hole;

introducing the liquid explosive into at least a portion of such fractures; and detonating the liquid explosive.

6. A method as defined in claim 1 wherein the fracturing step comprises:

forming at least one hole in unfragmented formation containing oil shale in the vicinity of such a boundary; and applying a sufficient hydraulic pressure to the unfragmented formation containing oil shale along at least a portion of the length of such a hole for forming fractures extending away from the hole in at least a portion of unfragmented formation containing oil shale in said first portion.

7. A method as defined in claim 6 wherein the fracturing step further comprises:

placing liquid explosive in at least a portion of the length such a hole having fractures extending away from at least such portion;

introducing the liquid explosive into such fractures; and detonating the liquid explosive.

8. A method as defined in claim 1 wherein the fracturing step comprises:

forming at least one hole in unfragmented formation containing oil shale in the vicinity of such a boundary;

placing liquid explosive in at least a portion of the length of such a hole;

forming fractures in at least the first portion of unfragmented formation and extending away from such hole;

introducing the liquid explosive into such fractures; and detonating the liquid explosive.

9. A method as defined in claim 1 wherein the step of fracturing is performed before the step of explosively expanding.

10. A method for recovery of shale oil from a fragmented permeable mass of particles containing oil shale in an in situ oil shale retort in a subterranean formation containing oil shale and from fractured unfragmented formation containing oil shale adjacent the fragmented permeable mass of particles, said retort having pillars of a first portion of unfragmented formation defining boundaries for the fragmented permeable mass of particles, said fragmented permeable mass being obtained by fragmenting part of a second portion of the formation within such boundaries; comprising the steps of:

forming at least one access hole in unfragmented formation in the vicinity of such a boundary;

propagating fractures from the access hole into at least a portion of unfragmented formation in the first portion and adjacent the second portion;

excavating a part of the second portion of the formation to form at least one void and leaving a remaining unfragmented part of said second portion extending away from such an excavated void, the excavated void volume being in the range of from about 10 to 25 percent of the volume of the fragmented permeable mass being formed;

explosively expanding said remaining part of said second portion toward such an excavated void for forming the fragmented permeable mass of particles;

passing a retorting gas through the fragmented mass of particles containing oil shale; and recovering carbonaceous products including shale oil from the retort.

11. A method as defined in claim 10 wherein the propagating step comprises:

forming another access hole in said first portion remote from the first access hole; and passing a sufficient electric current between electrodes placed in the two spaced apart access holes for fracturing at least a portion of unfragmented formation containing oil shale therebetween in said first portion.

12. A method as defined in claim 11 wherein the propagating step further comprises:

forcing a liquid into unfragmented portion in said first portion having fractures extending away from such an access hole with sufficient hydraulic pressure for enlarging at least a portion of such fractures.

13. A method as defined in claim 12 wherein the propagating step further comprises:

introducing a liquid explosive into at least a portion of the fractures in said first portion extending away from such an access hole; and detonating the liquid explosive.

14. A method as defined in claim 11 wherein the propagating step further comprises:

introducing a liquid explosive into fractures extending away from such an access hole into at least a part of said first portion; and detonating the liquid explosive.

15. A method as defined in claim 11 wherein the propagating step further comprises:

applying a sufficient liquid pressure to the unfragmented formation from at least a portion of the length of such an access hole for fracturing at least a part of the unfragmented formation in said first portion.

16. A method as defined in claim 15 wherein the propagating step further comprises:

introducing a liquid explosive into at least a portion of the fractures in said first portion extending away from such an access hole; and detonating the liquid explosive.

17. A method as defined in claim 10 wherein the propagating step further comprises:

introducing a liquid explosive into at least a portion of fractures in said first portion adjacent such an access hole; and detonating the liquid explosive.

18. The method as recited in claim 10 wherein a plurality of access holes are formed and a portion of such access holes at least partly define such a boundary between the fragmented permeable mass of particles containing oil shale and unfragmented formation containing oil shale.

19. A method as defined in claim 10 comprising:

forming at least one access hole into unfragmented formation in the vicinity of such a boundary from such an excavated void; and conducting the fracturing step adjacent such an access hole from such excavated void.

20. A method for forming an in situ oil shale retort containing a fragmented permeable mass of particles in a subterranean formation containing oil shale, said retort having pillars of a first portion of unfragmented formation defining boundaries for a fragmented permeable mass of particles, said fragmented permeable mass being obtained by fragmenting part of a second portion of the formation within such boundaries, comprising the steps of:

fracturing unfragmented formation containing oil shale in the first portion and adjacent the second portion;

excavating a part of the second portion of the formation to form at least one void and leaving a remaining unfragmented part of said second portion extending away from such an excavated void; and explosively expanding said remaining part of said second portion toward such an excavated void for forming the fragmented permeable mass of particles, having a void volume substantially the same as the volume of the excavated part of the second portion.

21. A method as defined in claim 20 wherein the step of fracturing comprises passing a sufficient electric current through at least part of said first portion for fracturing such part of the unfragmented formation containing oil shale.

22. A method as defined in claim 20 wherein the step of fracturing comprises applying a sufficient hydraulic pressure to at least a part of said first portion for fracturing such part of the unfragmented formation containing oil shale.

23. A method as defined in claim 20 wherein the fracturing step comprises:

forming at least one hole in unfragmented formation containing oil shale in the vicinity of such a boundary;

placing liquid explosive in at least a portion of the length of such a hole;

forming fractures in at least the first portion of unfragmented formation and extending away from such hole;

introducing the liquid explosive into such fractures; and detonating the liquid explosive.

24. An in situ oil shale retort having gas-retaining boundaries in a subterranean formation containing oil shale comprising:

a fragmented permeable mass of particles containing oil shale in the subterranean formation, having unfragmented formation defining gas-retaining boundaries for the fragmented permeable mass of particles, wherein at least a portion of the unfragmented formation defining such boundaries constitutes at least one pillar of unfragmented formation having lateral boundaries completely within the lateral outer gas-retaining boundaries of the retort, at least a portion of the unfragmented formation having fractures adjacent such a boundary for the fragmented permeable mass of particles.

25. An in situ oil shale retort as defined in claim 24 further comprising:

means for introducing retorting gas to the top of the fragmented permeable mass; and means for withdrawing flue gas from the bottom of the fragmented permeable mass.

26. A method for recovery of shale oil from a fragmented permeable mass of particles in an in situ oil shale retort in a subterranean formation containing oil shale and from fractured unfragmented formation containing oil shale adjacent the fragmented permeable mass, said retort having pillars of a first portion of unfragmented formation defining boundaries for the fragmented permeable mass of particles, said fragmented permeable mass being obtained by fragmenting part of a second portion of the formation within such boundaries, comprising the steps of:

fracturing unfragmented formation containing oil shale in the first portion and adjacent the second portion;

excavating a part of the second portion of the formation to form at least one void and leaving a remaining unfragmented part of said second portion extending away from such an excavated void;

explosively expanding said remaining part of said second portion toward such an excavated void for forming the fragmented permeable mass of particles, having a void volume substantially the same as the volume of the excavated part of the second portion, and retorting the fragmented permeable mass of particles containing oil shale and fractured formation containing oil shale adjacent to the fragmented permeable mass for recovering carbonaceous products including shale oil therefrom.

* * * * *

UNITED STATES PATENT AND TRADEMARK OFFICE

CERTIFICATE OF CORRECTION

PATENT NO. : 4,045,085

DATED : August 30, 1977

INVENTOR(S) : Donald E. Garrett

It is certified that error appears in the above-identified patent and that said Letters Patent are hereby corrected as shown below:

Column 5, line 37, "lowere" should be -- lowered --;
line 46, "weaknesses" should be -- weakness --.
Column 8, line 1, "pillrs" should be -- pillars --.
Column 9, line 31, "numbes" should be -- numbers --.
Column 11, line 20,"597,481" should be -- 567,481 --.
Column 13, line 60,"11" should be --10--.

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*